US007726077B2

(12) United States Patent
Dowling et al.

(10) Patent No.: US 7,726,077 B2
(45) Date of Patent: Jun. 1, 2010

(54) GUTTER COVER SYSTEM

(76) Inventors: Edna F. Dowling, P.O. Box 400, Nixa, MO (US) 65714; Torry B. Dowling, 1949 E. Cherry Street Ct., Springfield, MO (US) 65602

( * ) Notice: Subject to any disclaimer, the term of this patent is extended or adjusted under 35 U.S.C. 154(b) by 641 days.

(21) Appl. No.: 11/445,054

(22) Filed: Jun. 1, 2006

(65) Prior Publication Data

US 2007/0277446 A1 Dec. 6, 2007

(51) Int. Cl.
*E04D 13/00* (2006.01)

(52) U.S. Cl. ..... 52/12; 52/11; 52/13; 248/48.2

(58) Field of Classification Search ..... 52/11–15; 248/48.2

See application file for complete search history.

(56) References Cited

U.S. PATENT DOCUMENTS

| | | | | |
|---|---|---|---|---|
| 2,635,841 | A * | 4/1953 | Bauhammer et al. | 248/48.1 |
| 4,294,422 | A * | 10/1981 | Odekirk | 248/48.2 |
| 4,404,775 | A | 9/1983 | Demartini | |
| 4,435,925 | A | 3/1984 | Jefferys | |
| 5,189,849 | A | 3/1993 | Collins | |
| 5,271,192 | A | 12/1993 | Nothum, Sr. et al. | |
| 5,640,809 | A | 6/1997 | Iannelli | |
| 6,016,631 | A | 1/2000 | Lowrie, III | |
| 6,073,398 | A | 6/2000 | Williams | |
| 6,233,899 | B1 * | 5/2001 | Mellert et al. | 52/747.1 |
| 6,453,622 | B1 * | 9/2002 | Walters | 52/12 |
| 6,681,527 | B2 | 1/2004 | Baker | |
| 6,701,674 | B1 | 3/2004 | Albracht | |
| 6,732,477 | B1 | 5/2004 | Richard | |
| 6,745,517 | B2 | 6/2004 | Vahldieck | |
| 6,854,692 | B1 | 2/2005 | Winkel | |
| 6,883,760 | B2 | 4/2005 | Seise, Jr. | |
| 6,904,718 | B2 | 6/2005 | Fox | |
| 6,933,879 | B2 | 8/2005 | Richard et al. | |
| 6,935,074 | B2 | 8/2005 | Gramling | |
| 6,944,991 | B2 | 9/2005 | Kim | |
| 6,944,992 | B2 | 9/2005 | Brochu | |
| 6,993,870 | B2 | 2/2006 | McDonald et al. | |
| 7,117,643 | B2 * | 10/2006 | Brown | 52/12 |
| 2005/0017534 | A1 * | 1/2005 | Driscoll | 296/97.6 |
| 2006/0201068 | A1 * | 9/2006 | Shane | 52/11 |

* cited by examiner

*Primary Examiner*—David Dunn
*Assistant Examiner*—Daniel Kenny
(74) *Attorney, Agent, or Firm*—John C. McMahon

(57) ABSTRACT

A gutter cover system including a gutter cover and a bracket member having a shaft with a wall end having a curved member with a raised profile, and a swivel end; a tab member extending upwardly from the raised profile and forming an outwardly directed slot; and a lip member affixed to the swivel end configured to be mating received within the lip of a gutter. The gutter cover including a planar panel for positioning on the roof, an arcuate nose, and a lower member with a foot configured for matingly inwardly insertion into the slot; the raised profile structured to facilitate installation of the bracket member and installation of the gutter cover on the bracket member.

2 Claims, 11 Drawing Sheets

GUTTER COVER SYSTEM

FIELD OF THE INVENTION

This invention relates to gutter cover systems. More particularly, the invention relates to a gutter cover system with an improved gutter bracket and cover.

DESCRIPTION OF RELATED ART

For centuries, architects and builders have understood the beneficial value of directing rainwater away from structures to prevent damage to exterior walls, windows, doors, foundations, basements, landscaping, and to prevent erosion. The most popular and geographically accepted gutter system is the open channel gutter trough that runs parallel along the roof eaves of a building. Gutter systems are designed to direct rainwater away from buildings; however, if clogged with debris, they will fill up and overflow, and since the gutter is located at the buildings roof edge, overflowing water can now damage the interior, as well as the exterior, of the building. In order to accomplish the intended purposes, the gutter system must function properly, and to do this, the gutter trough must be free of any debris during rainfall. In geographical regions with abundant rainfall and lavish vegetation, a freshly cleaned open channel gutter trough can be full of debris within hours. With strong rain, heavy debris may accumulate simultaneously with large volumes of water; the task of keeping the gutter system clean becomes insurmountable. Therefore, homes in some regions are unable to utilize a gutter system.

As a result, gutter cover systems which shield gutters from above, have become quite popular. In this fashion, debris does not accumulate in the gutters and additionally squirrels, birds and other wildlife are denied access to the gutter and therefore the unpleasant chore of gutter cleaning is eliminated or at least significantly delayed.

The gutter cover must appropriately shield the gutter from debris yet avoid creating an undesirable alternative water drainage route from the roof, one which does not terminate in the gutter trough. Such an alternative route could lead to rotten wood along the fascia, etc., or could lead to deposition of water on the ground close to the foundation with the risk of structural damage over time.

In addition, gutter covers may not only be attached to the roof or fascia or the like, but may be typically affixed to the gutter itself. Many such attempts have included a bracket mounted within the gutter, often spanning the gutter from the lip to the wall side. Installing such a bracket is not a trivial matter. In particular, installing the bracket so as to achieve the appropriate mechanical tension must be done in an extremely small space within the gutter at a roof-level elevation. In addition, there may be objects within the gutter itself, such as gutter-stabilizing bolts or spikes close to the height of the gutter lip, making installation even more difficult.

Many systems addressing these problems have included a gutter bracket with elaborate structure to provide sufficient support within the gutter for stable and secure mechanical support of the gutter cover. One example is Albracht, U.S. Pat. No. 6,701,674 B1, which provides a large, cumbersome bracket. Mechanical stability is achieved, but the bracket is difficult to install because of its bulk and volume. Also the shape of the bracket requires that the profile shape of the gutter cover be bent and extended in order to conform to the profile of the bracket. This leads to additional labor cost in creating the bends and additional material required for the gutter cover profile to conform.

A non-system approach of interest is the gutter hanger (note that a gutter hanger is merely for supporting the gutter, but not adapted for mounting a gutter cover thereon) disclosed in Winkel, U.S. Pat. No. 6,854,692 B1, describing a swivel gutter hanger. As noted, Winkel is not intended for supporting a gutter cover and presents certain problems discussed in more detail below, due to the swivel portion being located approximately at the midpoint of the bracket.

What is needed is a gutter cover system which provides a simple bracket suitable for installation in a small area, yet providing sufficient mechanical tension to support the gutter cover and strengthen the guttering system. Also needed is a gutter cover itself which is minimized in size and with a simple profile for easy installation and optimized water routing. Finally, a gutter hanger for retrofitting damaged gutters is also highly desirable.

SUMMARY OF THE INVENTION

The present invention satisfies the need for a fast, convenient method of installing an improved gutter cover system with effective water routing. The invention provides an improved system which is relatively convenient to install, with an innovative gutter bracket and gutter cover that can be installed more quickly and effectively.

The present gutter bracket has a bracket member, a tab member and a lip member. The bracket member has a wall end and a swivel end and presents a longitudinal axis aligning the wall end and the swivel end. The wall end has a flange opposite from the swivel end as well as a flat portion along the longitudinal axis. The tab member extends upwardly from the bracket member, to form a slot. The lip member is affixed to the swivel edge, preferably by a screw. The lip member is configured to be matingly received within the lip of the gutter.

The improved gutter cover includes a planar upper panel for positioning on the roof, an arcuate nose at the lowest portion of the upper panel and disposed close to the gutter lip. The cover includes a planar lower member below the nose and a foot suitable for mating insertion into the slot.

The system improvements include a modified nose with an arcuate profile, free of sharp or bent edges to avoid diversion of water from the intended drainage route, i.e. terminating in the gutter trough. In particularly preferred embodiments, the bracket member presents a raised elevation for easier installation of the cover.

In addition, the present invention provides a gutter hanger and a gutter bracket which are both easier to install spanning the gutter from front to back, because of a swivel function preferably disposed relatively close to the front of the gutter, for easier installation, yet providing mechanical support for the gutter when the swivel portion is locked into rigid alignment.

DETAILED DESCRIPTION OF THE INVENTION

Figure 1:
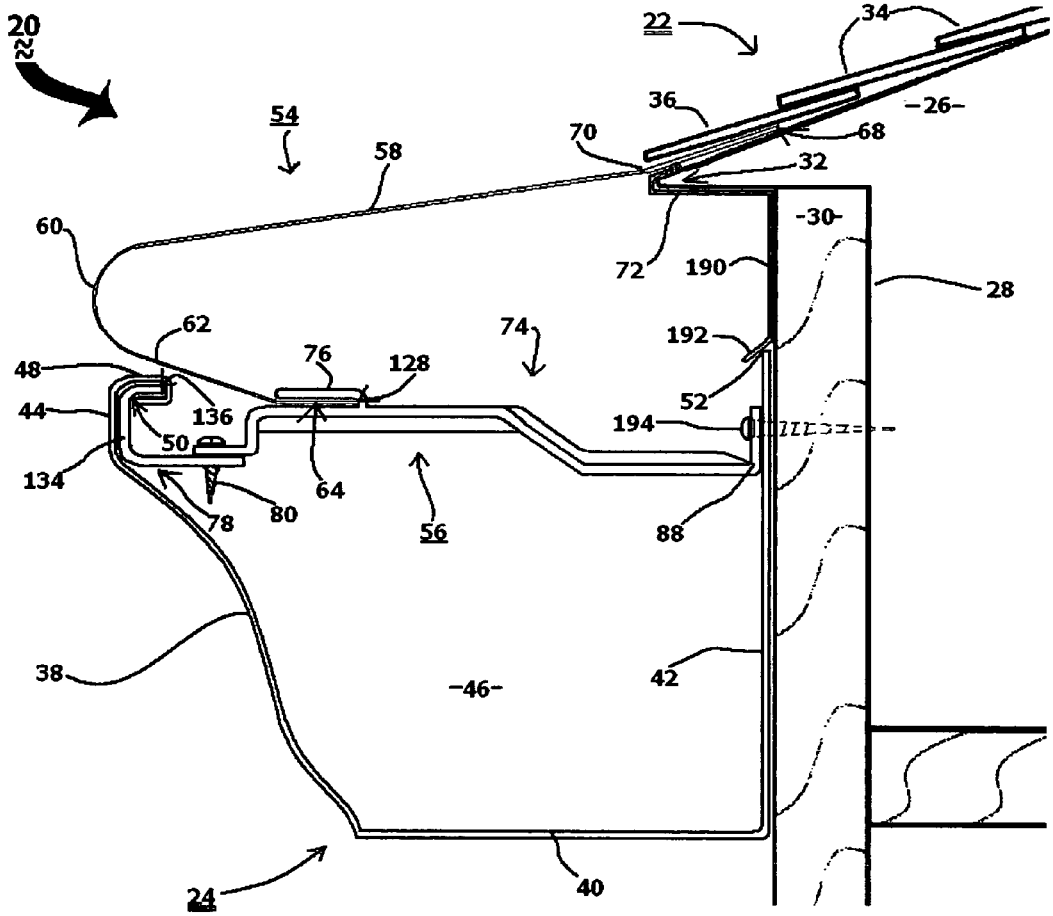
FIG. 1 is a side elevational view, partially sectional, illustrating the gutter cover system of the present invention installed on a house and configured with a gutter.

Referring now to the drawings in general and FIG. 1 in particular, the inventive gutter cover system 20 is shown mounted on a house 22 in operative association therewith, as well as a gutter 24. House (or other building or residential structure) 22 includes a roof deck 26, outer wall 28, fascia 30, roof edge 32, shingles 34, including a lower most shingle 36.

Gutter 24 includes a front wall 38, a gutter floor 40, back wall 42, a K-style lip 44 and an interior gutter trough 46. Lip 44 has uppermost portions 48 and an interior portion 50. Backwall 42 of gutter 24 has an upper edge 52.

Gutter cover system 20 has a gutter cover 54 and a gutter bracket 56 according to the present invention.

Figure 2:
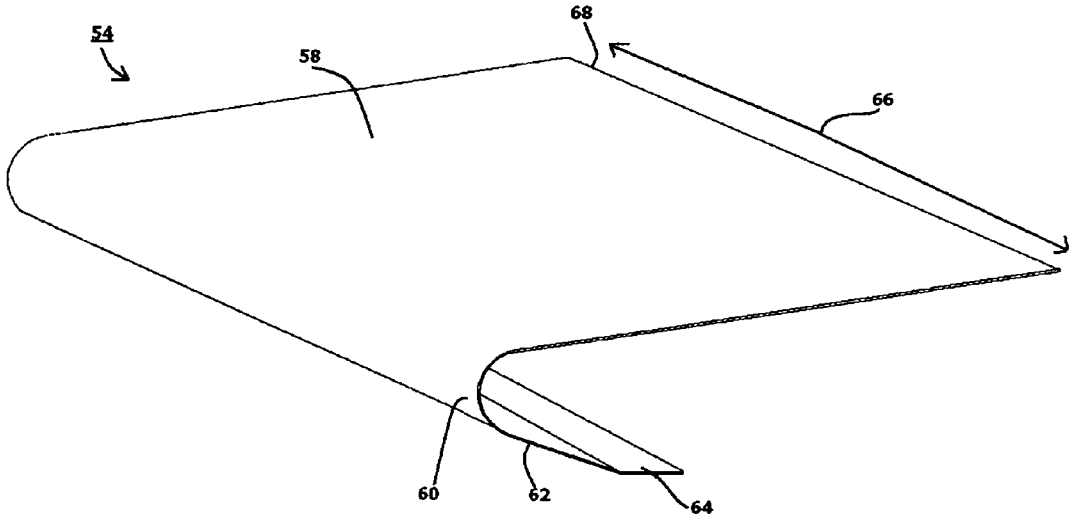
FIG. 2 is a perspective view of the inventive gutter cover.

Referring to FIG. 2, gutter cover 54 is shown in perspective by itself. Gutter cover 54 has a planar, upper panel 58, an arcuate nose 60, a lower member 62 and a planar foot 64. Gutter cover 54 is preferably made of aluminum, or alternatively made of copper or a suitable alloy. Cover 54 is typically manufactured in a five foot section as measured by the span indicated at reference numeral 66. Cover 54 may be chemically treated in order to promote surface tension with rainwater, or to enhance coloring or aesthetic coordination with the shingles 34 or house 22, as is well known in the art.

Upper panel 58 is substantially planar and imperforated, (i.e. no perforations) and includes an upper edge 68. Upon installation, upper panel 58 may include a bend point 70 if appropriate to accommodate the pitch of roof deck 26 (see FIG. 1). Upper panel 58 has a downward slope in profile from upper edge 68 down to nose 60 as will readily be appreciated by reference to FIG. 1. Upper panel 58 is fixed to lower most shingle 36 and roof deck 26 by a nail (not shown) or other means well known in the art somewhere between bend point 70 and upper edge 68.

Referring to FIG. 1 again, nose 60 is arcuate and preferably smooth in exterior surface. In particularly preferred embodiments nose 60 presents an interior circular radius so that nose 60 is substantially semi-circular in profile shape, with a substantially constant radius. In preferred embodiments, the constant radius of nose 60 is between ½ inch and two inches. In particularly preferred embodiments, nose 60 has a radius of about ½ inch, for purposes to be described below.

Still referring to FIG. 1, lower member 62 of gutter cover 54 is also substantially flat, planar and imperforated in preferred embodiments, with a downward slope of about 40° in particularly preferred embodiments.

Foot 64 of cover 54 is shown mounted in gutter bracket 56 as will be described in more detail below. Foot 64 has a length in profile, as shown in FIG. 1, of about ½ inch. As installed, foot 64 is substantially horizontal.

Figure 3:
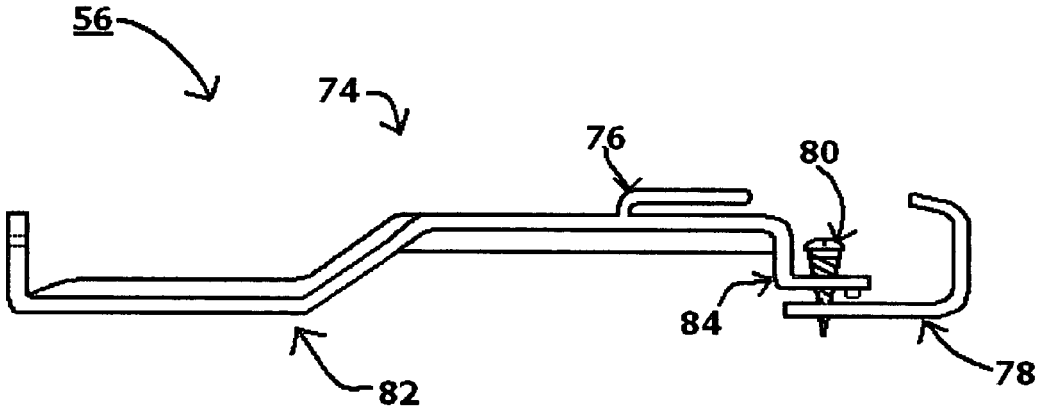
FIG. 3 is a side elevational view of the inventive gutter bracket.

Referring to FIG. 3, a preferred gutter bracket 56 of the present invention is shown in a side elevational view. Gutter bracket 56 has a bracket member 74, a tab member 76, a lip member 78 and a screw 80. It should be noted that bracket member 74 and lip member 78 are actually in abutting contact when installed but a slight gap is shown in FIG. 3 for ease of illustration. All elements of bracket 56 are made of aluminum in the preferred embodiment (with the possible exception of screw 80). Bracket member 74 generally has a wall end 82 and a swivel end 84.

Figure 4:
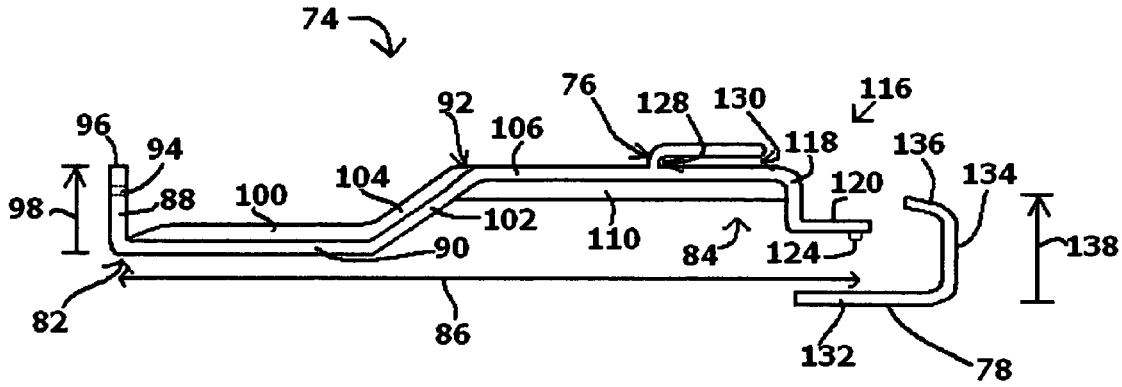
FIG. 4 is a side elevational view of the bracket of FIG. 3, partially exploded.

Referring to FIG. 4, wall end 82 and swivel end 84 serve cooperatively to define a longitudinal axis as indicated at reference numeral 86. Screw 80 has been omitted in FIG. 4 for ease of illustration. Lip member 78 is shown even further from bracket member 74, again for ease of illustration. Wall end 82 includes an upwardly extending flange 88, a shaft 90 and a curved member 92.

Flange 88 includes a flange hole 94 indicated by dotted lines (see also FIG. 8) and a top point 96. Top point 96 of flange 88 presents a first elevation with respect to shaft 90, as indicated by reference numeral 98. Shaft 90 is substantially flat, but has a central ribbed area 100 for additional strength (see also FIG. 5).

Curved member 92 includes a transitional region 102, upwardly extending from shaft 90. Transition region 102 of curved member 92 includes a supplemental ribbed area 104 which is integral and continuous with ribbed area 100.

Curved member 92 also includes an upper platform 106 of raised elevation with respect to shaft 90. Platform 106 forms an aperture 108 immediately below tab member 76 (see FIG. 5), having substantially the same dimensions of that of tab 76. The easiest method of manufacture is, in fact to "stamp-out" tab 76 and shape it upwardly, thereby creating aperture 108, as will readily be appreciated by reference to FIG. 5. Platform 92 includes three bevels 110, 112 and 114 (see FIG. 5). Bevels 110, 112 and 114 are formed around upper platform 116 for additional mechanical strength.

Swivel end 84 has a swivel region 116. Swivel region 116 includes a swivel ridge 118 and a swivel platform 120. Swivel platform 120 includes a swivel screw hole 122 (see FIG. 5). Swivel platform 120 also includes two detents 124 and 126 formed so as to provide extensions below swivel platform 120 (see FIG. 4 for detent 124 in profile). As viewed from above in FIG. 5, swivel platform 120 is substantially rectangular in shape, with a width of one inch and a length of ½ inch.

Referring once again to FIG. 4, tab member 76 extends upwardly from upper platform 106. Tab 76 includes a backstop 128 as shown. Tab 76 in cooperation with upper platform 106 forms a slot 130 for insertion of foot 64 during installation.

Still referring to FIG. 4, lip member 78 has a lip platform 132 and a bight member 134. Bight member 134 includes uppermost portion 136 which presents a second elevation relative to lip platform 132, as indicated at reference numeral 138. Lip platform 132 has two detent apertures 140, 142 and a lip screw hole 144, formed therein (see FIG. 5). In preferred embodiments, first elevation 98 of top point 96 of flange 88 is lower than second elevation 138 of uppermost portion 136 of bight member 134, for reasons to be discussed below.

Referring to FIG. 3, screw 80 is threaded and conventional in nature. Swivel screw hole 122 and lip screw hole 144 (see FIG. 5) are appropriately threaded for reversible threaded insertion by screw 80.

Figure 6:
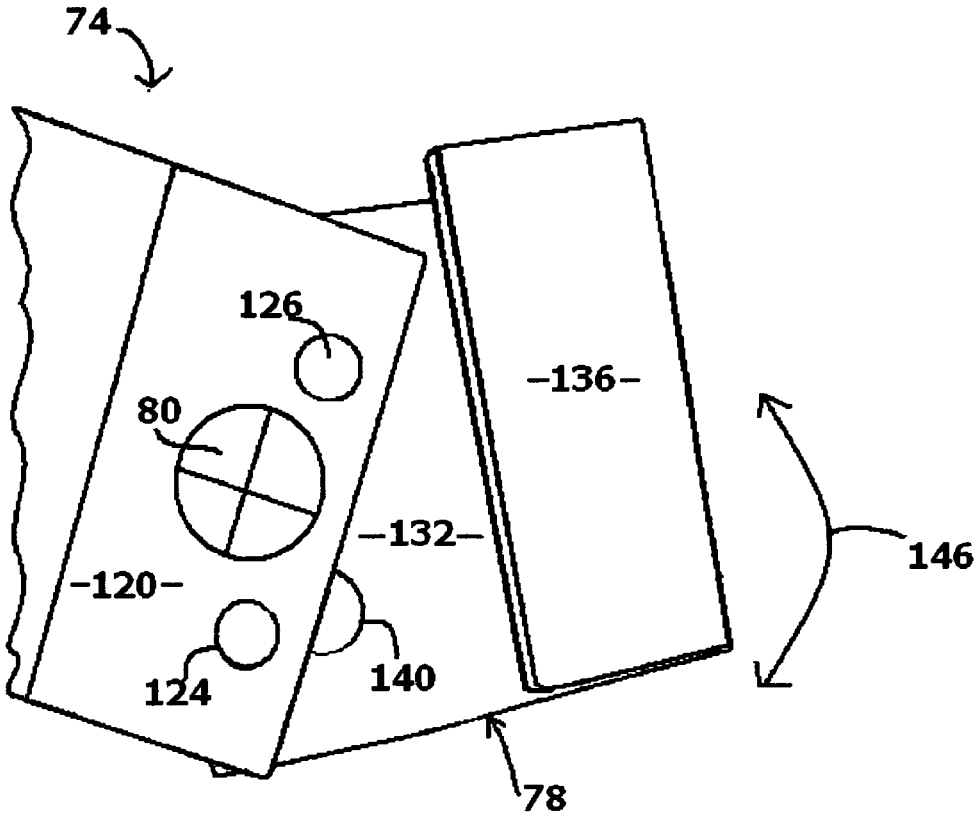
FIG. 6 is a partial plan view of the bracket of FIG. 3.

Referring to FIG. 6, lip member 78 and swivel platform 120 are shown in a skewed configuration as appropriate prior to installation, as will be discussed in more detail below. Screw 80 is threaded through swivel screw hole 122 as well as lip screw hole 144 (not shown in FIG. 6) but not completely secured, so that swivel platform 120 (and the rest of bracket member 74, not shown in FIG. 6) may swivel back and forth angularly about lip member 78 as indicated at reference numeral 146.

Figure 7A:
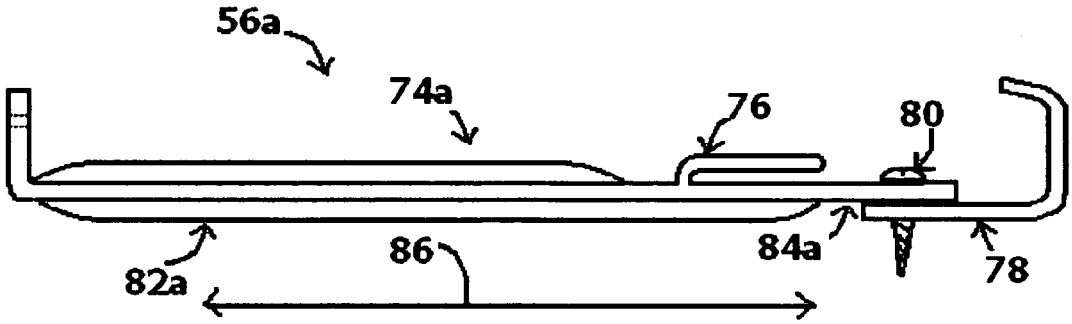
FIG. 7*a* is an alternative gutter bracket according to the invention, shown in a side elevational view.

Referring now to FIG. 7*a*, an alternative gutter bracket 56*a* is shown in a side elevational view. Gutter bracket 56*a* may be used in the same fashion as gutter bracket 56 of FIGS. 3 through 5, but is structurally modified so that curved member 92 is omitted. Gutter cover bracket 56*a* includes a bracket member 74*a*, tab 76, lip member 78, and a screw 80.

Bracket member 74*a* includes a wall end 82*a* and a swivel 84*a* as shown. Wall end 82*a* and swivel 84*a* define a longitudinal axis 86 in strictly analogous fashion to that as shown in FIG. 4 for bracket member 74.

Figure 7B:
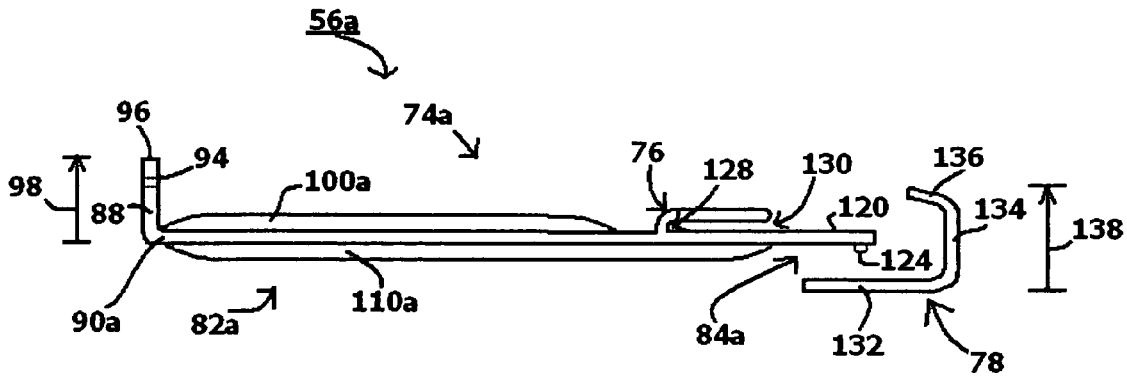
FIG. 7*b* is a partially exploded side elevational view of the alternative bracket of FIG. 7*a;*

Referring to FIG. 7*b*, wall end 82*a* includes flange 88 and an elongated shaft 90*a*. Flange 88 (exactly as in FIG. 4) includes flange hole 94 and top point 96. Top point 96 presents a first elevation relative to shaft 90*a* as indicated at reference numeral 98.

Shaft 90*a* is longer than shaft 90 (see FIG. 4), since bracket member 74*a* is essentially flat rather than curved (compare bracket 74 of FIG. 4). Shaft 90*a* has downwardly extending bevels on either side, namely 110*a* and 114*a* (bevel 114*a* is not shown in FIG. 7*b* but see FIG. 7*c*). Shaft 90*a* also includes a central ribbed area 110*a* (see also FIG. 7*c*). Ribbed area 110*a* and bevels 110*a*, 114*a* provide further mechanical strength for bracket member 74*a*. Swivel end 84*a* of bracket 74*a* includes swivel platform 120 in strictly analogous fashion to that of swivel platform 120 of FIG. 4.

Figure 7C:
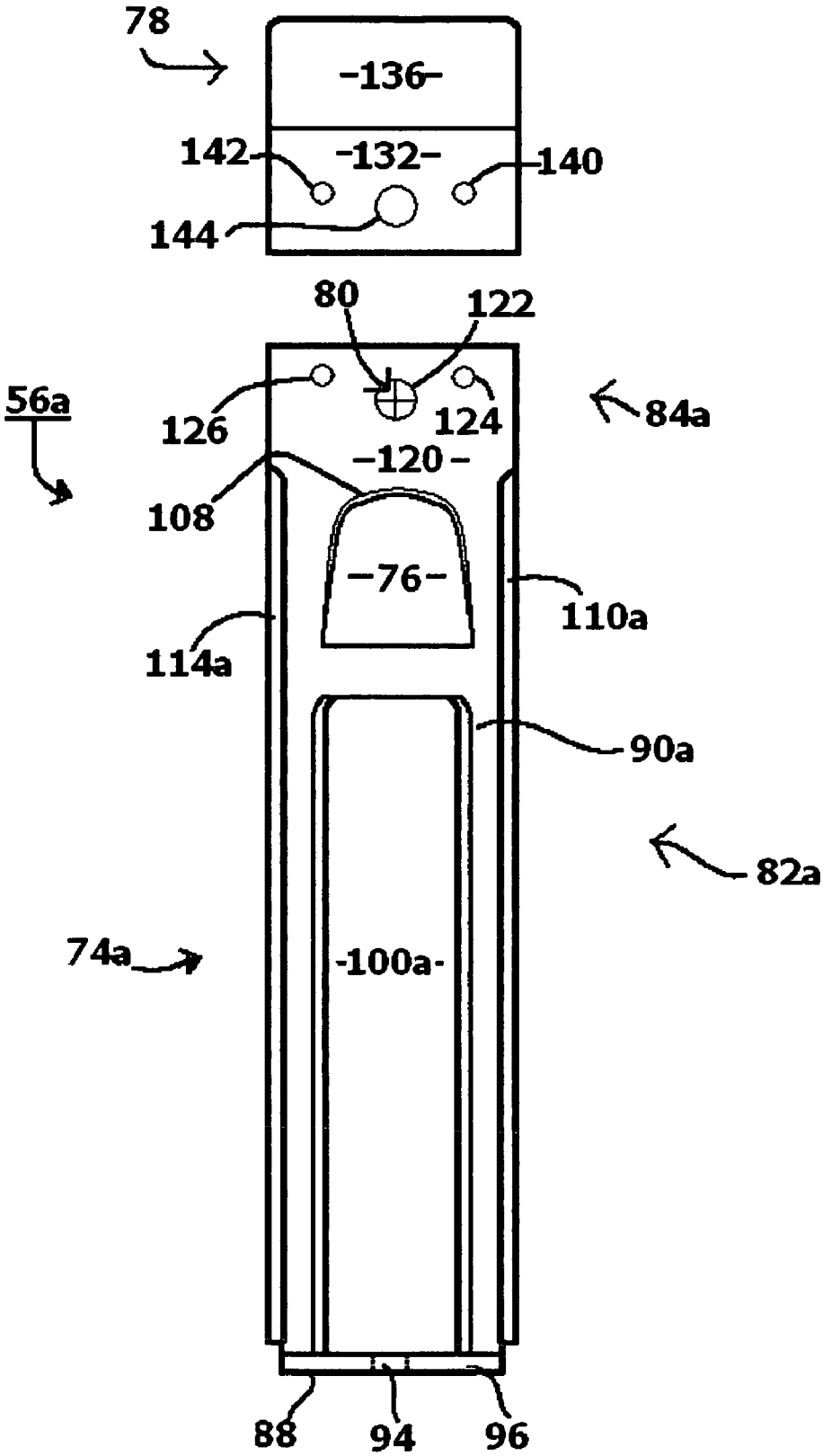
FIG. 7*c* is an exploded plan view of the alternative bracket of FIG. 7*a;*

Referring to FIG. 7*c*, gutter bracket 56*a* is seen in an exploded plan view, i.e. with bracket member 74*a* and lip member 78 shown detached. Swivel platform 120 is shown with detents 124 and 126 (see also FIG. 7*b* for detent 124 in profile). Also shown is threaded swivel screw hole 122 with screw 80 inserted.

Referring again to FIG. 7*b*, tab member 76 is formed in a strictly analogous fashion with tab member 76 of FIG. 4. Tab member 76 likewise includes backstop 128 at the end of slot 130. Referring FIG. 7*c*, tab 76 is punched out of shaft 90*a*, thereby creating corresponding aperture 108 below tab member 76.

Referring to FIG. 7*b*, lip member 78 includes lip platform 132, bight member 134 and uppermost portion 136 of bight member 134. Uppermost portion 136 presents an elevation relative to lip platform 132 as indicated by reference numeral 138.

Referring to FIG. 7*c*, lip member 78 is seen from above. Lip platform 132 is seen to have two detent apertures 140, 142 as well as threaded lip screw hole 144.

Figure 8:
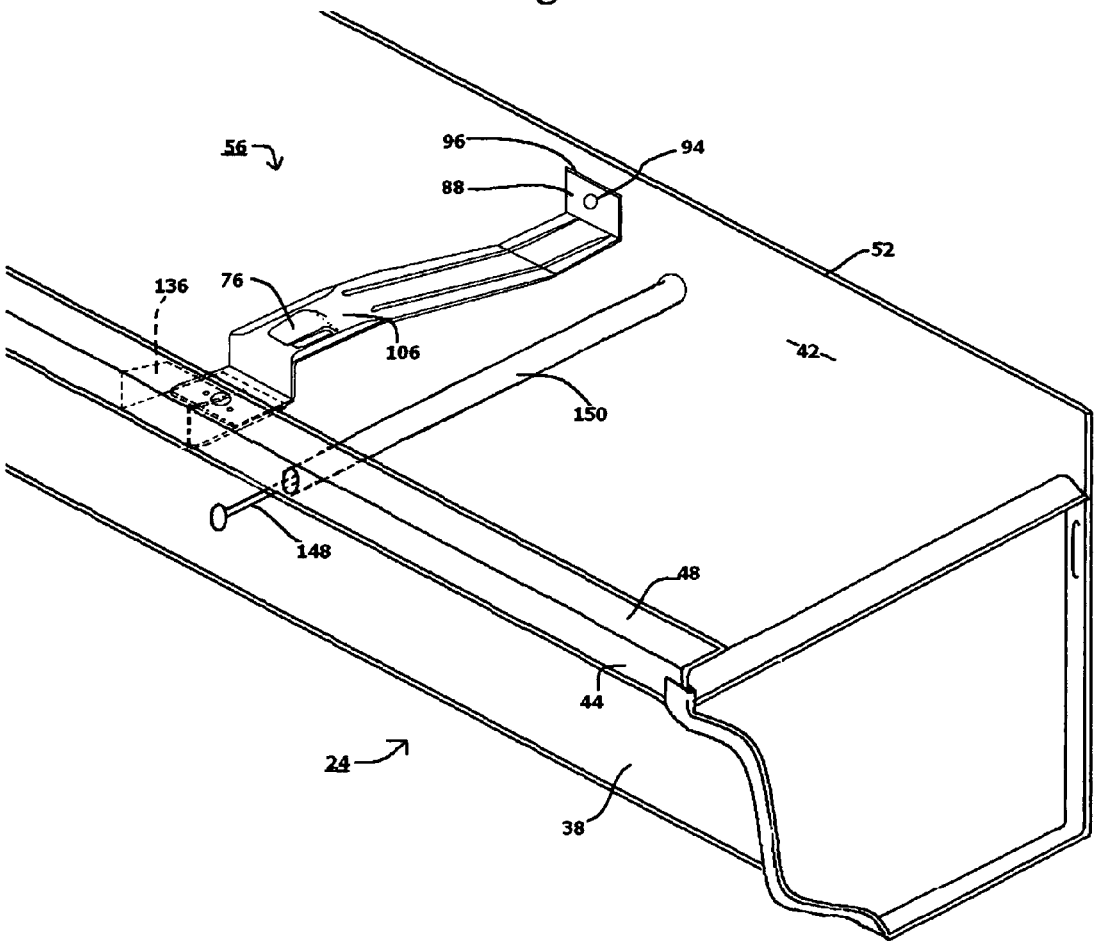
FIG. 8 is a perspective view of the inventive gutter bracket of FIG. 3 shown installed in a gutter, along with a gutter nail and sleeve.

Referring to FIG. 8, gutter bracket 56 is shown in the process of installation. Also shown is gutter nail or bolt 148 (partially shown), as it would be nailed through the exterior of K-style lip 44 of gutter 24 then spanning gutter 44 and driven through back wall 42 of gutter 24 and into fascia 30 (fascia 30 not shown in FIG. 8). Gutter nail 148 is received within nail sleeve 150 and is a common method of reinforcing and further securing gutter 24 to house 22.

Figure 9:
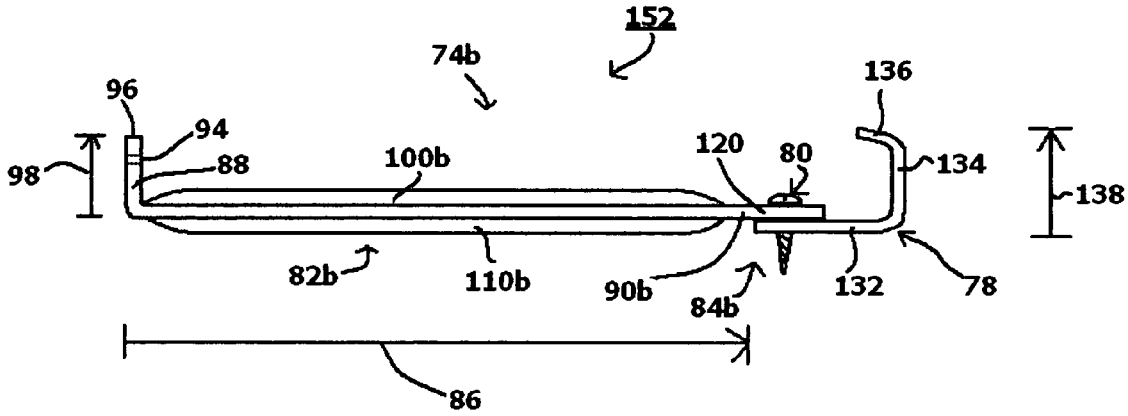
FIG. 9 is a side elevational view of a gutter hanger in accordance with the present invention.

Referring to FIG. 9, a gutter hanger 152 in accordance with the present invention is shown. The essential difference between gutter hanger 152 and gutter bracket 56*a* (see FIG. 7*a*) is that no tab member 76 is included. That is to say the purpose of gutter hanger 152 is for the repair or strengthening of gutter 24 (not shown in FIG. 9). In other words, the gutter hanger 152 does not serve as a site for securing foot 64 of gutter cover 54 (see FIG. 1).

Gutter hanger 152 has a bracket member 74*b*, lip member 78 and threaded screw 80. Bracket member 74*b* has a wall end 82*b* and a swivel end 84*b*. Wall end 82*b* and swivel end 84*b* present a longitudinal axis as indicated at reference numeral 86. Wall end 82*b* includes a flange 88 and an elongated shaft 90*b*.

Flange 88 is exactly the same in structure as flange 88 of FIG. 7*b* or FIG. 4. In particular, flange 88 includes flange hole 94 and top point 96. Top point 96 presents a first elevation with respect to shaft 90*b* as indicated by reference numeral 98.

Shaft 90*b* includes a central upraised ribbed area 100*b* extending substantially most of the way along shaft 90*b*. Shaft 90*b* also includes two downwardly extending bevels 110*b* and 114*b* (bevel 114*b* is not shown for ease of illustration but is strictly analogous with bevel 114*a* of FIG. 7*c*). Ribbed area 100*b* and bevels 110*b*, 114*b* are formed for additional strength for bracket member 74*b*, as will be readily appreciated.

Figure 5:
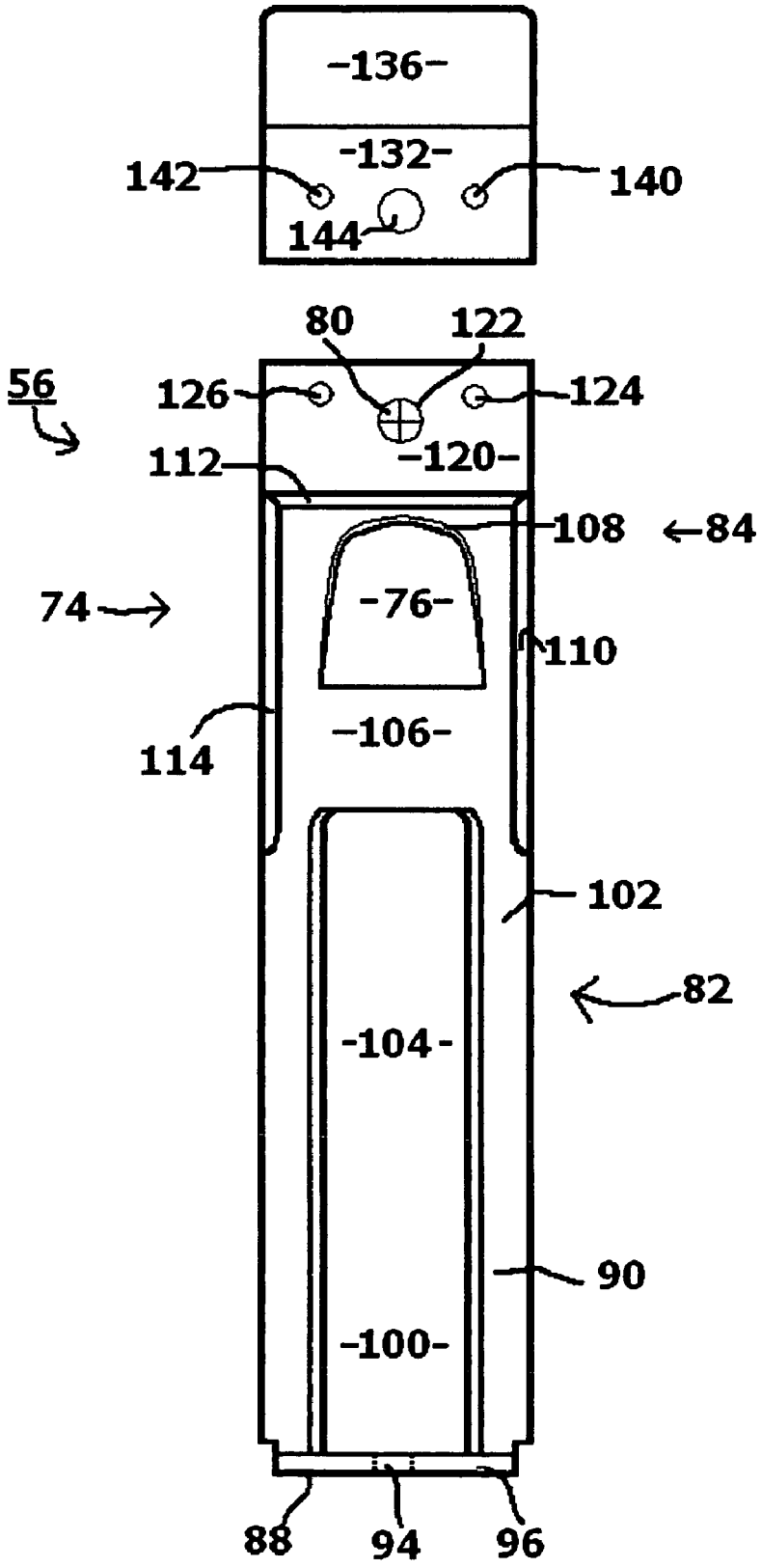
FIG. 5 is an exploded plan view of the bracket of FIG. 3.

Swivel end 84*b* includes swivel platform 120 which is exactly like swivel platform 120 shown in FIG. 7*c* and FIG. 5. In other words, swivel platform 120 of FIG. 9 includes downwardly extending detents 124 and 126 as well as threaded swivel screw hole 122 (these elements are not shown for ease of illustration).

Lip member 78 is exactly as shown in FIGS. 7*b* and 7*c* for gutter bracket 56*a*, as well as in FIGS. 4 and 5 for gutter bracket 56. In other words, lip platform 132 includes detent apertures 140 and 142 as well as threaded lip screw hole 144 (these elements are not shown for ease of illustration). Lip member 78 also includes bight member 134 and uppermost portion 136. Uppermost portion 136 presents a second elevation with respect to lip platform 132, as indicated at reference numeral 138. As in previous examples, first elevation 98 is lower than second elevation 138.

Figure 10:
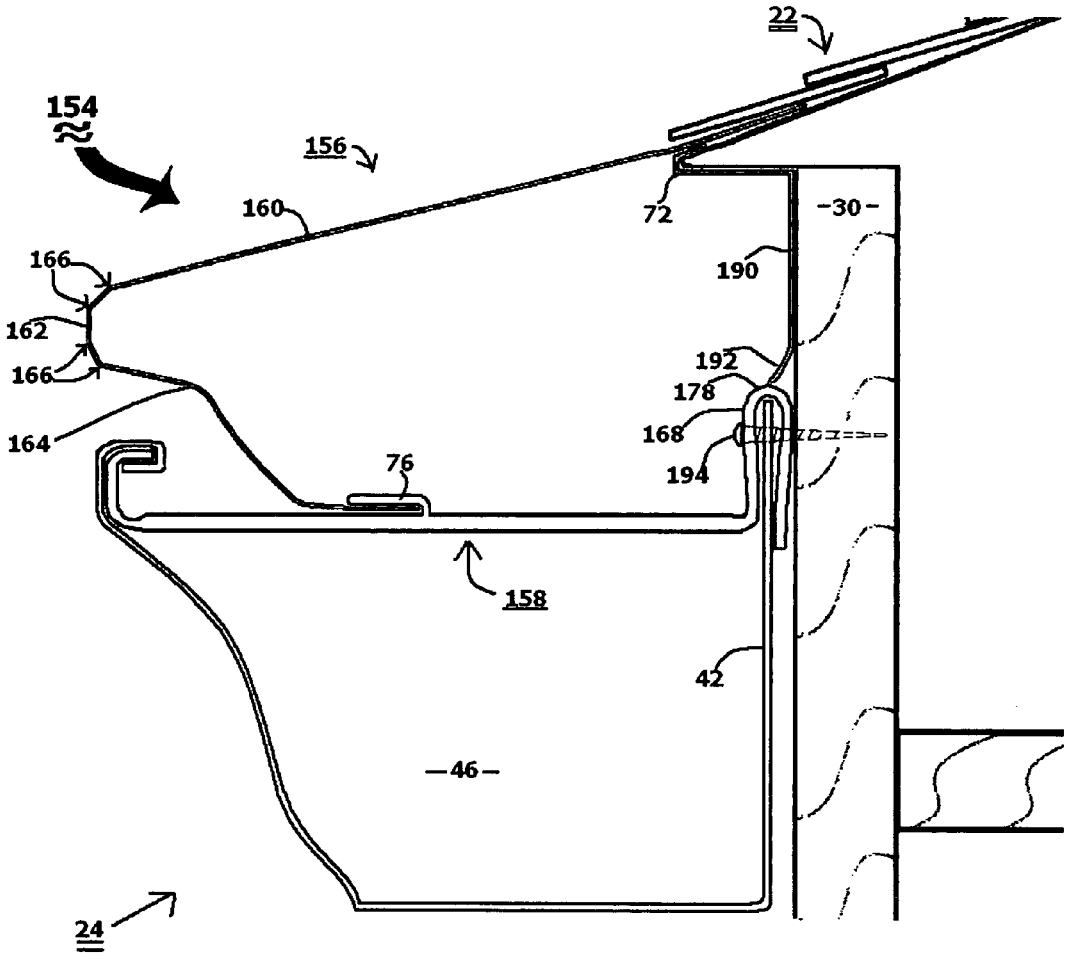
Fig. 10 PRIOR ART
FIG. 10 is a side elevational view, partially sectional, illustrating a prior art gutter cover system.

Referring to FIG. 10, a prior art gutter cover system 154 is shown, operatively adapted for use in conjunction with a house 22 or other building, as well as a gutter 24. Prior art system 154 includes a prior art gutter cover 156 and a prior art mounting bracket 158.

Prior art gutter cover 156 includes an upper panel 160, a nose 162 and a lower member 164.

Prior art nose 162 is disadvantageously not radially constant, as will be readily appreciated by reference to FIG. 10. In particular, it will be noted that nose 162 is not even continuously arcuate. In particular, prior art nose 162 includes bend points 166 as indicated. Bend points 166 are disadvantageous as will be noted below.

Furthermore, it will noted that prior art lower member 164 is not flat and planar in profile, but rather presents a curved profile.

Figure 11:
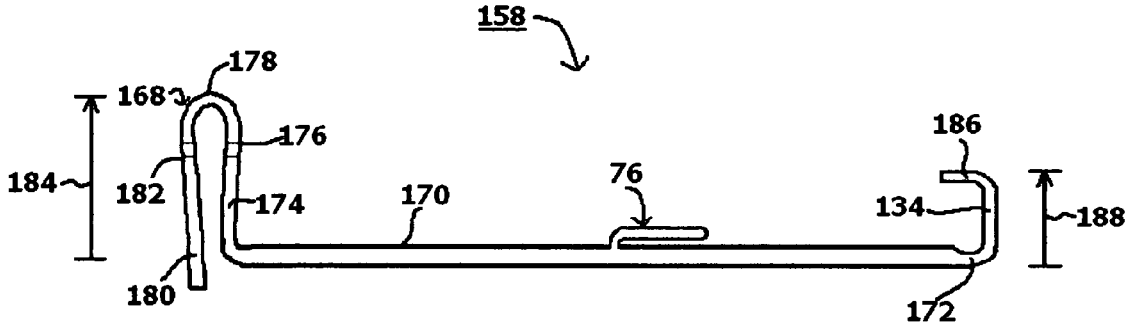
Fig. 11 PRIOR ART
FIG. 11 is a side elevational view of the prior art gutter bracket shown in FIG. 10.

Referring to FIG. 11, prior art bracket 158 will be discussed in more detail. Prior art bracket 158 includes a loop 168, a floor 170, a lip element 172 and tab member 76.

Loop 168 includes a front portion 174, and has formed therein a first loop aperture 176. Loop 168 also includes a top portion 178, and a back portion 180, with a second loop aperture 182 formed therein. First loop aperture 176 and second loop aperture 182 are elevationally aligned for purposes to be discussed below. Top portion 178 of loop 168 presents a first elevation with respect to floor 170 as indicated at reference numeral 184.

It will be noted that floor 170 extends integrally from loop 168 to lip element 172. Therefore it will be readily appreciated that there is no structure enabling a swiveling function for prior art bracket 158 in contradistinction to the mounting brackets 56 and 56*a* as well as gutter hanger 152 previously disclosed in accordance with the present invention.

Tab member 76 is conventional in nature. Lip element 172 includes a bight member 134 as well as lip top 186. Lip top 186 presents a second elevation with respect to floor 170, as indicated at reference numeral 188. It will be noted that first elevation 184 is higher than second elevation 188 which presents a disadvantage to be discussed below.

Referring once again to FIG. 10 it will be noted that drip edge 72 is mounted on house 22 in exactly the same fashion as indicated in FIG. 1. In particular, it will noted that drip edge 72 has a drain member 190 extending downwardly along fascia 30. At the bottom of drain member 190 of drip edge 72 is a routing element 192, the significance of which will be discussed below. Also note that prior art bracket 158 is affixed to fascia 30 by wall screw or nail 194, as will be discussed in more detail below.

The positioning of the swivel function will now be discussed. With reference to FIG. 4, it will be readily appreciated that gutter bracket 56 presents a total length along axis 86, i.e. from flange 88 to bight member 136. The position of screw 80 (see FIG. 3) along axis 86 determines the swivel action. It will be noted by inspection that the position of screw 80 along axis is at least 80 percent of the total length of bracket 56 (i.e. at least 80 percent of the way toward bight member 134). This relative axial position is considered optimum for swiveling as well as screw driver access for tightening screw 80. However other positioning of screw 80 (and swivel screw hole 122 and lip screw hole 144) is contemplated within the present invention. For example, the swivel function could be placed at a minimum of 60 percent of the total axial length toward bight member 134, or anywhere along the axial region closer than that to bight member 134. These comments with regard to placement of the swivel action also pertain to bracket 56*a* and hanger 152.

Installation of system 20 of FIG. 1 will now be discussed. First, a series of gutter brackets 56 of FIG. 1 (or alternatively gutter brackets 56*a* of FIG. 7*a*) must be installed. The typical ratio of gutter brackets 56 to covers 54 is typically two to one, i.e. two gutter brackets for each cover 54, although a ratio of three to one or even one to one (or any other ratio) can be used depending on the configuration of covers 54 to brackets 56.

The installation of one mounting bracket 56 will now be discussed. Bracket 56 is first put in a bent, swivel orientation as shown in FIG. 6, in other words, bracket member 74 is rotated slightly to achieve that configuration. Screw 80 is already inserted through swivel screw hole 122 and lip screw hole 144, but not yet completely tightened to allow such swivel action as indicated at reference numeral 146 of FIG. 6. In this fashion, mounting bracket 56 has effectively a shortened length and therefore can be easily inserted into gutter 24.

Next, uppermost portion 136 of bight 134 of lip member 78 is then fitted into interior 50 of lip 44 of gutter 24 as shown in FIG. 1, for mating, secure engagement.

Next, bracket member 74 is elevationally aligned so as to be the proper elevation with respect to back wall 42 of gutter 24. Then bracket member 74 is swiveled into position so that flange 88 abuts back wall 42 and bracket member 74 and lip member 78 are longitudinally aligned.

Next, screw 80 is tightened so that bracket member 74 may no longer be swiveled angularly with respect to lip member 78. In this fashion, with flange 88 of bracket member 74 abutting back wall 42 of gutter 24 at the appropriate elevation and swivel action prohibited by screw 80, gutter bracket 56 provides rigid mechanical support of gutter 24. Note that mating engagement of detents 124, 126 respectively with detent apertures 140, 142 further prevents swivel action.

Next, wall screw 194 is inserted through flange hole 94, then through back wall 42 of gutter 24 and into fascia 30 as indicated in FIG. 1. Now, gutter bracket 56 is securely, rigidly mounted within gutter 24 and affixed to house 22, providing beneficial mechanical support for gutter 24.

Next, foot 64 of cover 54 is inserted into slot 130 (see FIG. 4) until it is mechanically stopped at backstop 128 of tab 76. Depending on the configuration, foot 64 may also be inserted at this time into slot 130 of another bracket 56 advantageously spaced from the original bracket 56, as is well known in the art. The low profile of the nose 60 allows easier installation under the lowest shingle 36 and prevents the necessity of lowering gutter 24.

In this fashion, cover 20 now has structural support and may be fastened to roof deck 26. A bend point 70 may be created in upper panel 58 at any time during the process as deemed necessary to accommodate the slope of roof deck 26. Next, upper edge 68 of upper panel 58 of cover 20 is inserted between the lower most shingle 36 and roof deck 26. Upper panel 58 is then secured to shingle 36 and roof deck 26 by flat-head screw (not shown) or any other fashion well understood in the art.

As stated before, the installer may choose the appropriate number of brackets 56 to install in gutter 24 along the interior thereof. In other words, a ratio of two to one may be appropriate or, if only one bracket is mounted each five feet and cover 54 has a span of five feet (see reference numeral 66 in FIG. 2), then essentially each cover 54 could share a given bracket 56. Alternatively, additional brackets per cover may be installed for additional bolstering of gutter 24 and security of placement of covers 54.

Retrofitting technique using bracket 56 will now be discussed. For various reasons, it may be desirable to install one or more brackets 56 some time after the original installation, i.e. retrofitting. In this instance, the inventive bracket 56 offers additional benefits. After original installation, there is generally no access between back wall 42 and fascia 30 (see FIG. 1) due to compression of wall 42 against fascia 30 after insertion of wall screw 194. Advantageously, bracket 56 requires no such access, since retrofitting is performed in essentially the same procedure as the original bracket installation. In contradistinction, and with reference to FIGS. 10 and 11, the prior art bracket 158 does require such access for insertion of back portion 180 of loop 168. In the event that bracket 158 is used for retrofitting, the installer must either cut off back portion 180 prior to installation, or alternatively use all of loop 168 on the inside of back wall 42. In this alternative method, the extra length of back portion 180 may cause mechanical distortions gutter 24. In particular, lip 44 of gutter 24 may be mechanically deformed by such retrofit installation. In addition, the higher profile of loop 168 may result in undesirable contact with routing element 192 during retrofitting (see FIG. 10), while the low profile of flange 88 of bracket 56 of the present invention (see FIG. 1), eliminates any such contact with routing element 192.

Operation of system 20 as shown installed in FIG. 1 will now be described. The purpose of system 20 is to segregate debris from rainwater, discarding debris such as leaves, while retaining water and guiding it into gutter trough 46 of gutter 24. As will readily be appreciated, rainwater and debris coming off of shingles 34 will be naturally guided onto upper panel 58 of cover 54 by the downward slope of roof deck 26. The gentle sloping of upper panel 58 will continue the downward descent of rainwater on the top surface thereof until nose 60 is reached. At that point, debris such as leaves and twigs will naturally fall off the edge presented by nose 60 and fall harmlessly to the ground, having missed the interior of gutter 24 (note that nose 60 extends further from house 22 than lip 44 of gutter 24).

Rainwater however, due to the gentle sloping of upper panel 58, will maintain a moderate velocity which will result in rainwater following around the exterior of nose 60 and following the outside of lower member 62. This is due to the Coanda effect which is well known in the art, along with the surface tension between cover 54 and the rainwater. In other words, because of the beneficially small and constant radius of nose 60, surface tension between rainwater and nose 60 will cause the water to adhere to cover 54, traversing nose 60 and continuing to follow along the line of lower member 62. The constant radius of nose 60 in the preferred embodiment inhibits undesirable angular acceleration which could disrupt the Coanda effect. The imperforated nature of cover 54 serves also to promote a smooth flow of water, since water tension will not be disrupted by the inevitable dropping of rainwater through imperforations, as well as the disrupting of the speed and direction of rainwater and disrupting of adhesion of the water generally to cover 54.

It will be readily appreciated that the water will continue to descend down along lower member 62 until it arrives at the bottom surface of foot 64 where it will be gravitationally directed downward into trough 46 of gutter 24. Note that the vast majority of foot 64 surface area will not be positioned in slot 130 of a given bracket member 56 (see FIG. 2). In this fashion, rainwater will come off of lowermost shingle 34, traverse cover 54 and fall advantageously into trough 46 of gutter 24.

With further reference to prior art system 154 of FIG. 10 other problems will be noted. In particular, nose 162 is not smoothly and continuously arcuate but, rather has bend points 166. These bend points interrupt the smooth flow of water and may interfere with the natural surface tension between rainwater and cover 156. This may lead to a disadvantageous "drip-line" forming along the span of bend point 166. In this fashion, the adhesion of rainwater to cover 156 (and the downward flow thereof) is disrupted and the natural cohesion of water to itself is promoted so that drips and other water flow disruption may occur, slowing down the flow of water and even resulting in dripping of water off the edge of nose 162, missing gutter 24 altogether and therefore rainwater is deposited on the ground below gutter 24.

Another problem with prior art gutter bracket 158 of prior art system 154 is the lack of flexibility of positioning for installation. In particular, without a swivel function, prior art bracket 158 is more cumbersome to place properly to span gutter 24. Because it's effective length may not be changed, in contradistinction to the inventive brackets 56, 56*a* and gutter hanger 152 of FIG. 9. Therefore a quick and convenient, or even practical installation of prior art bracket 158 may be not possible.

Also, in some instances the lack of a raised elevation for tab member 76 may be result in increased difficulty in insertion of foot 64 into slot 130. For example, with reference to FIG. 8, the raised elevation of tab member 76, disposed on upper platform 106, advantageously obviates obstruction of the insertion of foot 64 (not shown in FIG. 8) into slot 130. Many gutters have such gutter nails 148 for spanning mechanical reinforcement as indicated. The elevation of a series of gutter nails 148 is typically at a height comparable to mounting bracket 56 because both are mounted at the elevation of K-style lip 44 of gutter 24. According to the present invention the raised elevation of tab member 76 due to its position on upper platform 106 gives it a heightened elevation and thus allows foot 64 of cover 54 (not shown) to avoid any undesirable obstruction by a series of gutter nails 148.

Also, referencing FIGS. 10 and 11, insertion of wall screw 194 may be more difficult when installing prior art bracket 158, since it must go through an additional layer of metal. In particular, loop 168 has both front portion 174 and back portion 180 (see FIG. 11 for more detail) and thus there is more spacing from fascia 30 in the installation. In addition, back wall 42 must be somewhat spaced from fascia 30 in order to accommodate insertion of back portion 180 of loop 168. Finally, insertion of wall screw 194 may result in air gaps between front portion 174, back wall 42 of gutter 24 and back portion 180 of loop 168. Such gaps can easily lead to a more cumbersome installation and may even make the mounting of prior art bracket 158 less secure. In addition such gapping may promote alternative water paths or sites for the collection of moisture.

Installation and operation of gutter hanger 152 of FIG. 9 will now be discussed. Gutter hanger 152 is installed in a strictly analogous fashion to that of gutter 56 of FIG. 3 or gutter bracket 56*a* of FIG. 7*a*. In other words, lip member 78 is positioned in interior 50 of gutter lip 44, then flange 88 is swiveled into position against back wall 42 of gutter 24. Once flange 88 is placed in a secure position of abutment against back wall 42 of gutter 24, screw 80 is then fully tightened to rigidly align lip member 78 with bracket member 74*b* along longitudinal axis 86. Finally, wall screw 194 or the like is then inserted through flange hole 94, back wall 42 and into fascia 30, in the strictly analogous fashion as shown in FIG. 1. In this fashion, hanger 152 may be used to retrofit guttering which has been dislodged or deformed by the contraction of ice or other mechanical disruptions, as are well understood in the art. After installation, gutter hanger 152 serves to rigidly and securely bolster gutter 24 so that future deformation or other mechanical damage to gutter 24 is either avoided or postponed.

Although the invention has been particularly shown and described with reference to preferred embodiments thereof, it will be understood by those skilled in the relevant art that various changes in form and details may he made therein without departing from the spirit and scope of the invention as defined in the appended claims.

What is claimed is:

1. A gutter cover system for retrofit use in conjunction with a gutter having a trough and a front upper lip and wherein the gutter is previously mounted on a wall of a building to receive runoff rain water from a roof of the building that is shingled; the gutter cover system comprising:

a) a plurality of mounting brackets adapted to be retrofit mounted on the gutter; each bracket being sized and shaped to be mounted between the gutter lip and extend rearwardly therefrom to the building wall; each bracket having a first portion adapted to be associated with the building wall and a second portion adapted to be associated with the gutter lip; each bracket having a swivel joining ends of the bracket first and second portions and being adapted to allow a person to swivel the first and second portions relative to each other during installation into the gutter; each bracket first portion having an upwardly extending flange adapted to receive a fastener for fixedly attaching the bracket first portion to the building wall; each bracket second portion having a forward lip member adapted to be snugly and securely received inside of and under the gutter lip such that after installation of the bracket in the gutter, the bracket extends between the lip and the building wall while providing support to the gutter against forces applied toward the wall against the lip of the gutter;

b) each bracket being bowed upwardly intermittently between the bracket lip member and the rearward side of the bracket first portion so as to provide an upper platform that is located at approximately the same elevation as a top side of the gutter lip when the bracket is mounted in the gutter;

c) each platform having a tab attached thereto and positioned so as to define an outward facing slot that is located substantially at least as high as the top of the gutter lip when mounted relative to the gutter;

d) a gutter cover comprising:

1) an elongate upper panel having a rearward distal end adapted to be received beneath and thereafter be located beneath the shingles on the roof; the upper panel being generally smooth and uniform and being sized and shaped to slope downwardly from a rearward end at the roof to a forward end thereof;

2) an arcuate nose; the nose joining smoothly with the frontward end of the upper panel; the nose being sized and shaped so that when the cover is mounted relative to the gutter, the nose is positioned over the gutter lip and extends at least somewhat outward form the lip relative to the building wall so that debris falling from the cover is urged to fall away from the gutter lip while water passing over the cover follows the contour of the nose toward the gutter;

3) a lower panel having a front edge secured to the lower side of the nose and a rearward edge; and 4) the rearward edge of the lower panel ending in a foot that is sized and shaped to be slidingly received in the slot on each bracket platform; the foot and the distal end of the lower panel cooperating with one another during assembly of the cover system to allow an operator to mount the cover with a single rearward movement both under the shingles and into the slot respectively.

2. The gutter cover system of claim 1 in combination with the gutter and wherein the nose extends outward relative to the gutter such that debris is directed to fall beyond and past the gutter while water follows the contour of the nose and lower panel to the gutter.

* * * * *

UNITED STATES PATENT AND TRADEMARK OFFICE

CERTIFICATE OF CORRECTION

PATENT NO. : 7,726,077 B2
APPLICATION NO. : 11/445054
DATED : June 1, 2010
INVENTOR(S) : Edna F. Dowling and Tony B. Dowling It is certified that error appears in the above-identified patent and that said Letters Patent is hereby corrected as shown below:

On the Title page Item (76)
Delete the name of the second named inventor of the patent and insert --Tony B. Dowling-- therefor.

Signed and Sealed this

Sixteenth Day of November, 2010

David J. Kappos

David J. Kappos
*Director of the United States Patent and Trademark Office*